US008821057B2

(12) United States Patent
Lambert

(10) Patent No.: US 8,821,057 B2
(45) Date of Patent: Sep. 2, 2014

(54) PACKAGING DEVICE HAVING AN ADJUSTABLE MAGNETIC CLOSURE SYSTEM

(75) Inventor: Claude Lambert, Saint Cloud (FR)

(73) Assignee: Qualipac, Neuilly sur Seine (FR)

( * ) Notice: Subject to any disclaimer, the term of this patent is extended or adjusted under 35 U.S.C. 154(b) by 0 days.

(21) Appl. No.: 14/112,246

(22) PCT Filed: Apr. 26, 2012

(86) PCT No.: PCT/FR2012/050928

§ 371 (c)(1),
(2), (4) Date: Nov. 25, 2013

(87) PCT Pub. No.: WO2012/150406

PCT Pub. Date: Nov. 8, 2012

(65) Prior Publication Data

US 2014/0093299 A1 Apr. 3, 2014

(30) Foreign Application Priority Data

May 2, 2011 (FR) ..... 1153721

(51) Int. Cl.

| | |
|---|---|
| ***B43K 7/06*** | (2006.01) |
| ***A45D 40/18*** | (2006.01) |
| ***A45D 40/06*** | (2006.01) |
| *A45D 40/00* | (2006.01) |

(52) U.S. Cl.

CPC ..... *A45D 40/18* (2013.01); *A45D 2040/0012* (2013.01); *A45D 40/06* (2013.01)

USPC ..... 401/194; 401/100; 206/385

(58) Field of Classification Search

USPC ..... 401/49, 52, 98, 99, 100, 194, 195; 206/581, 385; 222/386, 390

See application file for complete search history.

(56) References Cited

U.S. PATENT DOCUMENTS

| | | | | |
|---|---|---|---|---|
| 8,556,527 | B1 * | 10/2013 | Chou | 401/98 |
| 2007/0014624 | A1 * | 1/2007 | Fogelson et al. | 401/131 |
| 2007/0025802 | A1 * | 2/2007 | Dieudonat et al. | 401/100 |

FOREIGN PATENT DOCUMENTS

| | | | |
|---|---|---|---|
| EP | 2281476 | A1 | 2/2011 |
| FR | 2680761 | A1 | 3/1993 |
| FR | 2787970 | A1 | 7/2000 |
| WO | WO-86/02812 | A1 | 5/1986 |

* cited by examiner

*Primary Examiner* — David Walczak

(74) *Attorney, Agent, or Firm* — IM IP Law PLLC; C. Andrew Im

(57) ABSTRACT

A packaging device having a magnetic closure system establishing a particular angular orientation between two elements of the device. The packaging device for a cosmetic product comprises a container to house the product. The container comprises a visual mark on a side surface thereof and a removable case including an internal cavity to receive the container which can slide inside the cavity until it is fully housed inside the case. The case comprises a side hole that opens into the internal cavity. The device comprises at least a first permanent magnet borne by the container and at least a second permanent magnet borne by the case. The magnets being configured such as to define the angular position of the container in relation to the second axis, such that the visual mark on the container is positioned in line with the hole in the case.

6 Claims, 1 Drawing Sheet

PACKAGING DEVICE HAVING AN ADJUSTABLE MAGNETIC CLOSURE SYSTEM

RELATED APPLICATIONS

This application is a §371 application from PCT/FR2012/050928 filed Apr. 26, 2012, which claims priority from French Patent Application No. 11 53721 filed May 2, 2011, each of which is herein incorporated by reference in its entirety.

TECHNICAL FIELD OF THE INVENTION

The present invention refers to a device for packaging products, particularly in the cosmetic field. More precisely, the invention refers to a device having two parts, said two parts being assembled by means of magnets, said magnets allowing a particular positioning of one of the two parts relative to the other. The invention is applicable to a variety of cosmetic products, but refers particularly to a tube of lipstick for cosmetic or care purpose.

BACKGROUND OF THE INVENTION

Classically, a tube of lipstick comprises a container receiving the lipstick. The container is provided with a mechanism making it possible to move the lipstick between a storage position retracted into the body and a use position projecting from said body. The mechanism is in general operated by means of a wheel rotatingly mounted onto the body. Such a mechanism is described for example in document FR2787970.

The container comprises an open end, through which the lipstick can project in order to be used. In order to protect the lipstick between uses, this end is typically inserted into a removable tubular cover.

The cover must be maintained fixed on the container in order to prevent it from being detached inadvertently. However, an intentional opening in order to use the lipstick must remain easy.

Document FR2680761 describes a lipstick whose container and cover are maintained in contact by the magnetic attraction between a magnet, supported by the container or the cover, and a magnetic material, respectively supported by the cover or the container.

The force of attraction generated by the magnet is sufficient to hold the cover on when carrying the tube, while allowing a user to open it easily.

When such a container has the shape of a cylinder of revolution, such a system does not make it possible however to determine in a selective way the angular position of the container relative to the cover.

In addition, in a conventional way, a tube of lipstick can be opened by taking hold of the cover with one hand and the other end of the container with the other hand, and then by exerting a traction thereupon. Indeed, the cover usually covers only part of the container.

OBJECT AND SUMMARY OF THE INVENTION

In order to propose a new packaging design for cosmetic products, the Applicant has however carried out a packaging device comprising a container, as well as a case serving as a cover, in which the container is fully housed in the closed position.

In order to reach the container, the case is provided with a side hole. This hole makes it possible to exert on the container an axial thrust so that it can slide out of the case.

It is advantageous to make the hole in the case coincide with a visual mark on a side surface of the container, this mark being for example a logo or a decorative pattern.

It is thus interesting to provide the case and/or the container with means making it possible to angularly position the container relative to the case when the device is in the closed position.

The invention aims at solving this problem and moreover at providing a holding means between the case and the container.

Indeed, the invention refers to a packaging device for a cosmetic product, including a container for containing the product, said container having substantially the shape of a cylinder of revolution about a first axis, said container comprising along said axis an open end opening to the product, said container comprising a visual mark on a side surface, said device moreover including a removable case, substantially cylindrical about a second axis, the case including an internal cavity able to receive the container, the container being able to slide inside said cavity along the second axis, until it occupies a so-called closed position, in which the open end of the container is closed by the case, the container being then fully housed in the case, said case comprising a side hole opening into the internal cavity, said device comprising at least one first permanent magnet supported by the container and at least one second permanent magnet supported by the case, said magnets being positioned so as to be substantially in the same plane perpendicular to the axes when the device is in the closed position, one of the magnets including two opposite magnetic poles on a surface oriented towards the other magnet, the polarity of said other magnet being chosen in order to determine the angular position of the container relative to the second axis, so that the visual mark of the container is positioned in line up with the hole in the case.

Thus, when the container is inserted into the case in an inappropriate angular position, the two magnets are positioned with their opposite faces having the same polarity. A magnetic repulsion between the first and second magnets then generates a rotation of the container inside the internal cavity, so that the magnets are positioned with their opposite faces having opposite polarities. In this position, the visual mark of the container coincides with the hole in the case and can thus be seen from the outside of the device. In addition, the magnetization maintains the case on the container and prevents it from being detached inadvertently.

In a preferential way, the case comprises two permanent magnets arranged substantially symmetrically relative to the second axis, said two magnets having opposite polarities.

Thus, in the event of a bad angular positioning of the container, the two magnets of the case exert a magnetic force of repulsion on the magnet of the container, which facilitates the rotation thereof. In the same way, in the event of a correct angular positioning, the two magnets of the case contribute to hold the container on.

In a preferential way, the container is of lipstick type, comprising a body for housing the product, as well as an actuation wheel rotatingly mounted on the body, said body and said wheel being in line up with the first axis. However, the container can contain another cosmetic product, such as for example a cream or a paste.

BRIEF DESCRIPTION OF THE DRAWINGS

The invention will be better understood when reading the following description and examining the annexed figures.

These are given as an indication and by no means a restriction of the invention. The figures show.

DETAILED DESCRIPTION OF THE EMBODIMENTS

Figure 1:
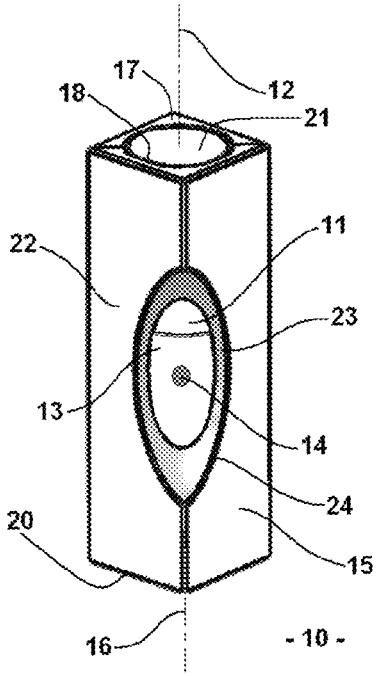
FIG. 1: a perspective view of a packaging device according to an embodiment of the invention.

FIG. 1 shows a view of a packaging device 10 according to an embodiment of the invention. The device 10 is of lipstick type. The device 10 includes a container 11, able to contain a lipstick. The container 11 has substantially the shape of a cylinder of revolution along a first axis 12. An external side surface 13 of the container 11 has a visual mark 14, for example a logo or a decorative pattern.

The device 10 also comprises a case 15, into which the container 11 can be inserted. The case is substantially cylindrical, said cylinder which can have a base of varied shape, such as for example a round, oval or polygonal shape. In the example in FIG. 1, the cylinder forming the case 15 has a square base.

Said cylinder develops along a second axis 16. In the position represented in FIG. 1, the axis 16 coincides with the axis 12.

A frontal face 17 of the case 15 has an opening 18 into an internal cavity 19 (see FIG. 2), along the axis 16. The internal cavity 19 has substantially a cylindrical shape, so that the case 15 can be fitted onto the container 11. It is possible to insert the container 11 into the cavity 19 through the opening 18, then to push said container along the axis 16 until it occupies a so-called closed position, represented in FIG. 1. In this closed position, an end of the container 11 abuts against a bottom 20 of the case 15. All the container 11 is then housed in the cavity 19. More precisely, a bottom 21 of the container 11 is coplanar with the face 17 of the case, or is set back from this face, but not projects therefrom.

A side surface 22 of the case 15 comprises a hole 23 opening into the internal cavity 19. Thus, when the device 10 is in the closed position, a side surface 13 of the container 11 can be seen from the outside.

Preferentially, the hole 23 has a shape and dimensions adapted so that the end of a finger can be applied onto the surface 13 and a thrust can be exerted on this surface along the axis 16. This thrust allows the bottom 21 of the container to project from the face 15 of the case, which makes it possible to take hold of the container 11 in order to use the product therein.

An edge 24 of the hole 23 can have varied shapes, for example a round, oval or polygonal shape, or a succession of arcs of circles and/or rectilinear segments.

In particular for esthetic reasons, it is advantageous to arrange the mark 14 in line up with the hole 23, in order to make said mark visible when the device 10 is in the closed position.

However, because of the round shape of the opening 18, the container 11 can be inserted into the cavity 19 with an unspecified angular orientation between the hole 23 and the mark 14. The device thus comprises means for aligning these two elements.

Figure 2:
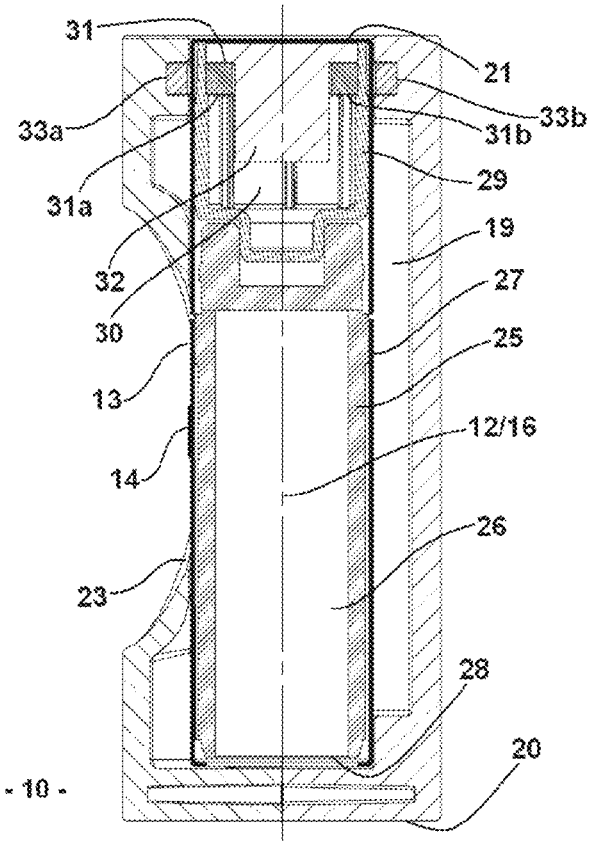
FIG. 2: a sectional view of the device in FIG. 1.

FIG. 2 shows an axial sectional view of the device 10 in FIG. 1. In FIG. 2, the device 10 is also represented in the closed position.

In particular, FIG. 2 shows the interior of the cavity 19, receiving the container 11. Said container 11 is of lipstick type. It comprises in particular a body 25 for housing a lipstick, said lipstick being able to be placed into a cylindrical housing 26. Said body 25 is surrounded by an external sheath 27. The body 25 is part of a rotating mechanism, which allows the lipstick to slide out of the housing 26 through an open end 28. Such a mechanism is conventional for lipsticks for cosmetic or care purposes. An example of such a mechanism is described in document FR2787970 in the name of the Applicant.

When the device 10 is in the closed position, the end 28 is closed by the bottom 20 of the case 15, which fulfills its function of stopper of the container 11.

The container 11 moreover comprises an actuating wheel 29 for said mechanism. The wheel 29 is mounted onto the body 25 so as to rotate relative to the axis 12, said body and wheel being in line up with the axis 12.

The wheel 29 has a substantially cylindrical shape about the axis 12. Said wheel is hollow and delimits a cavity 30.

A permanent magnet 31, having an annular shape, is inserted into said cavity. The magnet 31 is in a plane perpendicular to the axis 12.

An external side surface of the magnet 31 has two opposite polarities. More precisely, the ring 31 comprises two parts 31 a and 31*b*, symmetrical to a plane passing through the axis 12 and perpendicular to the cutting plane in FIG. 2. The magnet 31 is diametrical, i.e. the parts 31*a* and 31*b* have opposite polarities.

Such polarities are obtained by a particular process for manufacturing the annular magnet 31. Such magnets are known from the state of the art.

According to an alternative, the diametrical magnet 31 can be replaced by two magnets having the shape of half-circles, having opposite polarities.

The ring 31 is fitted onto a stopper 32, which closes the cavity 30 and forms the bottom 21 of the container 11. Preferably, the stopper 32 is made from a heavy material, for example a metal, in order to make the bottom 21 heavier.

Figure 3:
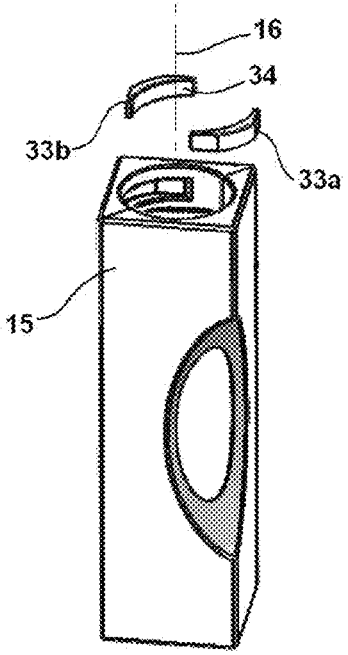
FIG. 3: a partial exploded view of the device in FIG. 1.

In addition, near the opening 18, the case 15 contains two permanent magnets 33*a* and 33*b*. FIG. 3 shows an exploded view of the case 15 and the magnets 33*a* and 33*b*.

The magnets 33*a* and 33*b* have a substantially symmetrical shape and position relative to the axis 16. The magnets 33*a* and 33*b* have in particular the crescent shape. An internal side surface 34 of the magnets 33*a* and 33*b* opens onto the cavity 19 and is substantially complementary to an external side surface of the wheel 29. In the closed position as in FIG. 2, the magnets 33*a* and 33*b* are substantially coplanar with the magnet 31.

The internal side surfaces of the magnets 33*a* and 33*b* have opposite polarities. More precisely, the magnet 33*a* has a polarity opposite that of the part 31*a* of the magnet 31 and the magnet 33*b* has a polarity opposite that of the part 31*b*.

Thus, when the container 11 and the case 15 are positioned as in FIG. 2, a magnetic attraction takes place, respectively between the magnet 33*a* and the part 31*a*, and between the magnet 33*b* and the part 31*b* of magnet 31.

This magnetic attraction is sufficient to maintain the container 11 in contact with the case 15, in order to prevent said container from sliding out of the case under the effect of its own weight.

For example, the force of attraction exerted by the magnets (31, 33*a*, 33*b*) is preferentially comprised between 1.5 and 3 Newton, while the total weight of the device 10 is approximately 30 grams.

In addition, this force of attraction is easily compensated by a user placing his/her finger against the surface 13 of the container 11 at the hole 23 and exerting a thrust having a component along the axis 12. The bottom 21 of the container

11 is thus moved so as to project from the case 15. The magnets (33*a*, 33*b*) are not then opposite the annular magnet 31 anymore and the attraction is suppressed.

In addition, when the container 11 and the case 15 are positioned as in FIG. 2, the mark 14 of the surface 13 can be seen through the hole 23.

On the other hand, if the container 11 is inserted into the cavity 19 in an angular position different from that in FIG. 2, it is possible that the magnets (33*a*, 33*b*) are placed opposite a part of the magnet 31 having a polarity identical to that of said magnets (33*a*, 33*b*).

A magnetic repulsion will then tend to make the container 11 swivel in the cavity 19, so that the part 31*a* is placed opposite the magnet 33*a* and the part 31*b* opposite the magnet 33*b*, respectively.

The mark 14, which could be dissimulated by the case 15, will be then seen through the hole 23.

In the example represented in FIG. 3, the surfaces 34 of the magnets (33*a*, 33*b*) form an arc of circle having an apical angle of approximately 120°. The magnets (33*a*, 33*b*) thus do not form a complete periphery of the cavity 19. Thus, the angular position of the container 11 relative to the case 15 can vary from a low angle, without a magnetic repulsion occurring between the magnets (31, 33*a*, 33*b*). This angle of variation can be modified according to the dimensions and/or the force of attraction of the magnets.

Preferably, in order not to interfere with the magnets (31, 33*a*, 33*b*), the other components of the device 10 are made from materials having a low or zero magnetic susceptibility, such as plastic or diamagnetic metals.

The invention claimed is:

1. A packaging device for a cosmetic product, comprising:

a container for containing the product, said container having substantially the shape of a cylinder of revolution about a first axis, said container comprising along said first axis an open end adapted to open to the product and a visual mark on a side surface;

a removable case substantially cylindrical about a second axis and comprising an internal cavity configured to receive the container and a side hole opening onto the internal cavity, said container being able to slide inside said internal cavity along the second axis, until it occupies a closed position in which the open end of the container is closed by the removable case, the container being then fully housed inside the removable case;

at least one first permanent magnet supported by the container and at least one second permanent magnet supported by the removable case, said permanent magnets being positioned so as to be substantially in the same plane perpendicular to the two axes when the device is in the closed position, wherein one of the permanent magnets comprises two opposite magnetic poles on a surface oriented towards the other permanent magnet; and wherein the polarity of said other permanent magnet being chosen so as to determine an angular position of the container relative to the second axis, so that the visual mark of the container is positioned to line up with the side hole in the removable case.

2. The device according to claim 1, wherein the removable case comprises two permanent magnets arranged substantially symmetrically relative to the second axis, said two permanent magnets having opposite polarities.

3. The device according to claim 1, wherein the container is of tube-of-lipstick type, comprising a body for housing the product and an actuating wheel rotatably mounted onto the body, said body and said actuating wheel being in line with the first axis.

4. The device according to claim 1, wherein the first permanent magnet has an annular shape and is arranged in a plane perpendicular to the first axis, said first permanent magnet comprises two parts symmetrical relative to said first axis, said two parts having opposite polarities.

5. A device according to claim 1, wherein the first permanent magnet is arranged near a bottom of the container.

6. A device according to claim 1, wherein the second permanent magnet has a crescent shape.

* * * * *